US006848138B1

(12) United States Patent
Maier et al.

(10) Patent No.: US 6,848,138 B1
(45) Date of Patent: Feb. 1, 2005

(54) PATIENT SUPPORT SURFACES

(76) Inventors: Edmund K. Maier, 197 River Walk Ct., Simpsonville, SC (US) 29681; Richard W. Raburn, 216 Circle Slope Dr., Simpsonville, SC (US) 29681; Mark D. Chastain, 461 Brockman Rd., Greer, SC (US) 29651

( * ) Notice: Subject to any disclaimer, the term of this patent is extended or adjusted under 35 U.S.C. 154(b) by 0 days.

(21) Appl. No.: 09/474,235

(22) Filed: Dec. 29, 1999

Related U.S. Application Data

(62) Division of application No. 09/191,579, filed on Nov. 13, 1998, now Pat. No. 6,223,369.
(60) Provisional application No. 60/065,563, filed on Nov. 14, 1997.

(51) Int. Cl.[7] ..... A47C 17/00
(52) U.S. Cl. ..... 5/730; 5/734; 5/727
(58) Field of Search ..... 5/727, 730, 731, 5/734, 736, 632, 648, 691; D6/596

(56) References Cited

U.S. PATENT DOCUMENTS

| | | | | |
|---|---|---|---|---|
| 3,222,697 A | | 12/1965 | Scheermesser | |
| 3,319,274 A | | 5/1967 | Upton | |
| 3,507,071 A | | 4/1970 | Bryson | |
| 3,742,528 A | | 7/1973 | Münch | |
| 3,846,857 A | | 11/1974 | Weinstock | |
| 4,214,326 A | | 7/1980 | Spann | |
| 4,224,706 A | * | 9/1980 | Young et al. | 5/713 |
| 4,628,557 A | | 12/1986 | Murphy | |
| 4,665,573 A | * | 5/1987 | Fiore | 5/731 |
| 4,741,058 A | * | 5/1988 | Williams et al. | 5/731 |
| 4,768,251 A | | 9/1988 | Baskent | |
| 4,862,538 A | | 9/1989 | Spann et al. | |
| 4,901,387 A | * | 2/1990 | Luke | 5/731 |
| 5,025,519 A | | 6/1991 | Spann et al. | |
| 5,070,560 A | | 12/1991 | Wilkinson | |
| 5,249,319 A | | 10/1993 | Higgs | |
| 5,252,278 A | | 10/1993 | Spann et al. | |
| 5,412,821 A | | 5/1995 | Wilkinson | |
| 5,421,044 A | | 6/1995 | Steensen | |
| 5,454,993 A | * | 10/1995 | Kostich | 5/648 |
| 5,487,196 A | | 1/1996 | Wilkinson | |
| 5,580,504 A | | 12/1996 | Spann et al. | |
| 5,649,331 A | | 7/1997 | Wilkinson et al. | |
| 5,652,985 A | | 8/1997 | Wilkinson et al. | |
| 5,699,570 A | | 12/1997 | Wilkinson et al. | |
| 5,787,531 A | * | 8/1998 | Pepe | 5/710 |
| 6,256,822 B1 | * | 7/2001 | Weston et al. | 5/732 |

FOREIGN PATENT DOCUMENTS

| | | |
|---|---|---|
| DE | 2856758 | 7/1980 |
| FR | 1113473 | 3/1956 |
| WO | WO 8102384 | 9/1981 |
| WO | WO 9314677 | 8/1993 |

* cited by examiner

*Primary Examiner*—Lynne H. Browne
*Assistant Examiner*—James M. Hewitt

(57) ABSTRACT

Multiple varieties of patient support surfaces are presented with a common modular assembly primarily including a perimeter chassis and integrated upper support element. Perimeter bolsters provide relatively firmer support for gently prompting a patient towards the center of the bed, without obstructing regular entry and egress. The added stability facilitates safer transfers and better sitting at the edge of the bed. Pressure redistribution air cylinders (turned either longitudinally or laterally) are captured by shaped, slotted inner bolsters and underside arches of an integral foam topper. Each foam topper integrally incorporated may include a sloping heel pressure relief section for redistributing load to relatively more pressure-tolerant lower legs and calves.

7 Claims, 8 Drawing Sheets

PATIENT SUPPORT SURFACES

PRIORITY CLAIM

This application is based on Provisional Application U.S. Serial No. 60/065,563 filed on Nov. 14, 1997, and based on prior regular U.S. patent application Ser. No. 09/191,579, filed on Nov. 13, 1998, now U.S. Pat. No. 6,223,369, and priority is hereby claimed from both such cases. The present application is a divisional of U.S. Ser. No. 09/191,579, filed Nov. 13, 1998 now U.S. Pat. No. 6,223,369.

BACKGROUND OF THE INVENTION

The present invention relates generally to improved patient support surfaces and more particularly to combinations of foam and air technologies which are selected so as to lend themselves to certain common modular assembly features, in the context of improved performance and/or costs.

Healthcare costs generally as well as patient well being may be greatly effected by the degree of pressure relief for patients confined to beds for significant periods of time. Pressure sores (eg. decubitus ulcers), potentially leading to infections and other worsened conditions or complications can occur from prolonged pressure exposure, such as experienced by those confined to beds, whether in a hospital, nursing home, or private residence. Considerable efforts have been made to provide mattress systems or patient support surfaces which effectively redistribute and equalize pressure forces at the interactions between the patient and the support surface. Generally speaking, the more sophisticated techniques for achieving such pressure reductions are relatively more involved and therefore more expensive to manufacture and/or use. Certain generally effective techniques involve the use of elongated air tubes or cylinders variously combined with foam pieces. Examples of embodiments having four generally longitudinal elongated air tubes are set forth in commonly owned U.S. Pat. Nos. 5,070,560 and 5,412,821. Such patents include the use of relatively stiffened lateral slats to help convey and redistribute forces laterally from one air tube to another. Such redistribution takes place over relatively limited areas of contact between the respective elements. While such approach is generally effective, one aspect of the present invention seeks to improve on the redistribution and equalization of pressure forces in the context of using such elongated air tubes and to otherwise improve the function thereof.

Another aspect of patient support surfaces generally relates to patient safety. Specifically, through either voluntary or involuntary movement (such as during sleep), patients may tend to move around on a support surface, including movement towards the edge of such surface. Many bed systems have large metal rails or other similar devices to help prevent accidental injury in the event that a patient inadvertently rolls off of the patient support surface. Such barriers or other buildups may prove awkward and obstructive whenever it is otherwise desired to assist a patient with entry to or egress from a bed.

Another aspect of patient safe interaction involves a potential tendency for some air mattress systems to "roll" or boost a patient forward as they are seated on the edge of a support surface. Such situation could cause a patient to tend to lose balance if they egress from a bed unassisted. Again, obstructions or buildups put in place to help prevent such occurrences otherwise interfere with desired patient transfers or edge-of-bed sitting.

Still another particular aspect of patient support surfaces relates to the relatively high degree of pressure forces which are placed on the heels of a patient. The relatively excessive pressures focused on the heels are often difficult forces to be effectively accommodated by many existing patient support systems. Such is particularly true where a system seeks to address total comfort from a balanced perspective, as opposed to focusing on heel pressure reduction. Hence, excessive or undesired heel pressure levels remain, resulting in patient discomfort and/or negative health consequences.

Another general limitation of static non-powered air tube technology relates to potential tube air loss. Ordinarily, there are no mechanisms for compensating for any air losses or other causes of pressure/inflation changes from the original specifications established by the manufacturer.

The disclosure of all U.S. patents noted in this application, above or hereinafter, are fully incorporated herein by reference.

SUMMARY OF THE INVENTION

The present invention recognizes and addresses various of the foregoing problems, and others, concerning patient support surfaces. Thus, broadly speaking, a principal object of this invention is improved patient support surfaces. More particularly, a main concern is improved patient support surfaces of the type involving combinations of foam and air technology.

It is therefore another particular object of the present invention to provide an overall construction for a grouping of different patient support surfaces involving combinations of foam and air technology which are facilitated by modular assembly components.

It is another general object of the present invention to provide perimeter foam construction techniques which cooperate with improved tube/foam interface components to collectively improve combined foam and air technology construction for both improved comfort and maximized structural integrity.

Another general object of the present invention is to provide improved patient support surfaces with reference to patient safety. More specifically, it is an object to facilitate safer transfers and more stable edge-of-bed sitting. In such context, it is an object to provide patient support surfaces which gently prompt a patient towards the center of the bed without requiring awkward buildups or structures which would otherwise obstruct entry to or egress from such patient support surfaces.

Still a further more particular object of the present invention is to provide inner bolster and foam topper constructions which work in concert with integrated air tubes or cylinders. More specifically, it is an object to provide interlocking, integrated designs which provide flexible, progressive support while maximizing structural integrity of the overall patient support surface.

It is another object to provide improved heel comfort by redistributing and equalizing loads to more relatively pressure-tolerant lower legs and calves. It is a particular object to achieve such improved heel comfort and improved patient health by providing particular sloping heel pressure relief sections incorporated into various embodiments of foam mattress toppers integrally built into different embodiments of patient support surfaces in accordance with this invention.

Yet another present object is to provide an embodiment of static non-powered patient support surface which is nonetheless able to be "recharged" in the field. In other words, it is an object to achieve recalibration of static air cylinders in the field at various periodic intervals of use (such as a certain number of months), to return their inflation specifications to the original manufacturer specs.

It is another object to provide a modular assembly chassis which may be used in common with a number of different embodiments of patient support surfaces (such as involving progressively sophisticated technologies) for creating a line of surface products based on the efficiency of common features. In such context, it is an object to formulate constructions which inherently provide improved patient protection against unintended rolling near the edge of the patient support surface or unintended forward pitching from the edge of the support surface during entry thereto or egress therefrom.

Additional objects and advantages of the invention are set forth in, or will be apparent to those of ordinary skill in the art from, the detailed description herein. Also, it should be further appreciated that modifications and variations to the specifically illustrated and discussed features and steps or materials and devices hereof may be practiced in various embodiments and uses of this invention without departing from the spirit and scope thereof, by virtue of present reference thereto. Such variations may include, but are not limited to, substitution of equivalent means and features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, elements, or steps, or their equivalents (including combinations of features or steps or configurations thereof not expressly shown in the figures or stated in the detailed description).

One exemplary embodiment of the present invention relates to improved patient support surfaces having perimeter bolster features which facilitate structural integrity and patient protection. Other present exemplary embodiments include combinations of inner bolster features and foam toppers with underside features for engaging and capturing prepositioned longitudinal and/or lateral placed air cylinders, for improved patient support surface integrity and performance.

Yet other exemplary constructions comprising present exemplary embodiments include foam toppers which have integrally incorporated therewith a sloping heel pressure relief section for improved patient heel health.

Still further, other present exemplary embodiments include various combinations of the foregoing features so as to result in a modular assembly common to different embodiments of static or dynamic and/or non-powered or powered patient support surface constructions.

Still further exemplary embodiments relate to the methodology involved with such exemplary foregoing mattress embodiments which comprise static non-powered air cylinder configurations. More particularly, such methodology relates to the ready ability to recharge such static air cylinders "in the field" (such as at a hospital or nursing home facility or even at a private residence) so as to reestablish the original manufacturer's inflation specifications.

Those of ordinary skill in the art will better appreciate the features and aspects of such embodiments and methodologies, and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
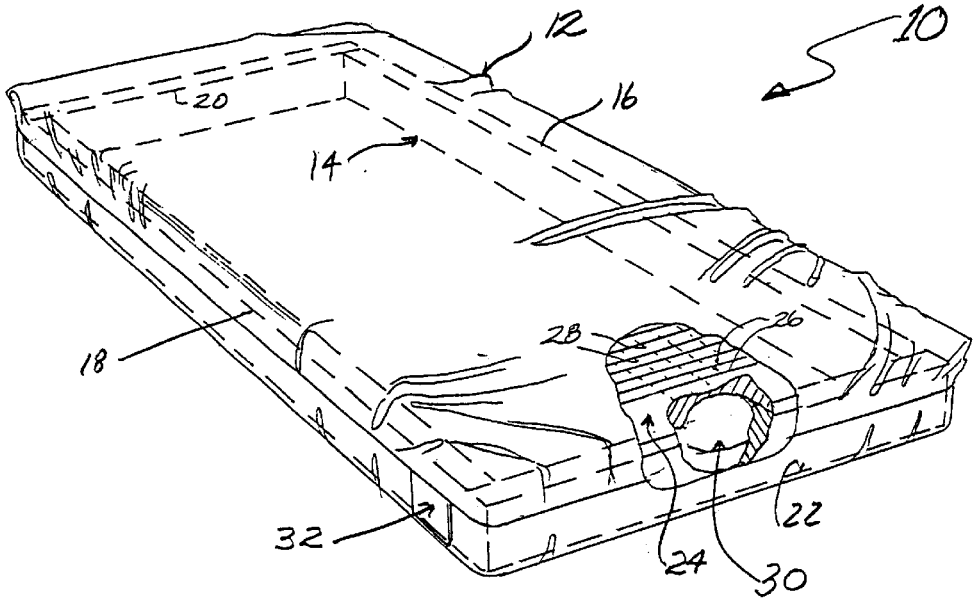
FIG. 1 is a generally top and partial side perspective view, in partial cutaway, of a patient support surface in accordance with the present invention, and primarily illustrating certain modular assembly aspects thereof.

Repeat use of reference characters throughout the present specification and appended drawings is intended to represent same or analogous features, elements, or steps of the invention.

DETAILED DESCRIPTION OF THE PREFERRED EMBODIMENTS

It is to be understood that the present language is by way of example and description only and is not intended to limit the broader scope of the subject invention as otherwise disclosed herewith, including features as referenced in the figures. FIG. 1 is a generally top and partial side perspective view of a patient support surface generally 10 showing an arrangement in accordance with the subject invention. Patient support surface 10 and generally all other similar embodiments in accordance with this invention include an exterior fitted cover 12. Cover 12 may comprise various fabrics, such as a stretch fabric of different materials. As understood by those of ordinary skill in the art, such fabric may be provided with other technological features, such as for minimizing moisture buildup, while yet being fluid proof, cleanable, self-deodorizing, and/or treated with a permanent antimicrobial agent. Pleated design may be provided also for full integration with shear-relieving surfaces of foam toppers contained therein. Turning handles may be optionally provided.

FIG. 1 represents an overall view for the purpose of illustrating that patient support surface 10 may comprise an arrangement suitable for modular assembly. In particular, a perimeter bolster 14 is illustrated in dotted line as enclosed within covering 12. Such bolster 14 may include a pair of opposing longitudinal elements 16 and 18 and an opposing pair of end rails or elements 20 and 22 integrally associated therewith. Preferably, perimeter bolster 14 comprises resilient polyurethane materials with selected characteristics. The several components 16, 18, 20, and 22 thereof may be joined by gluing or the like, as well understood by those of ordinary skill in the art.

As further shown in partial cutaway in present FIG. 1, a foam topper generally 24 may be integrally included within patient support surface 10. Particularly the upper support surface of such foam topper may include a variety of constructions designed and intended to facilitate pressure relief. Pressure relief, for example, may be provided by a number of lateral cuts or channels generally 26 formed in such surface as illustrated in solid line. It is to be understood that a number of longitudinal cuts or channels may also optionally be provided (as represented generally by dotted lines 28) for improved shear-relief performance or other improved features. Such longitudinal features 28 may be practiced in any of the embodiments herewith, though for clarity they are represented only in present FIG. 1.

As will be well understood by those of ordinary skill in the art, the combination of lateral channels 26 and longitudinal channels or cuts 28 results in a plurality of separate upright support elements, the size and construction of which may vary over the surface of topper 24 so as to provide selected support characteristics. Examples of such various arrangements as may be practiced in combination with the subject invention are discussed throughout commonly owned U.S. Pat. Nos. 4,862,538; 5,025,519; 5,252,278; and 5,580,504, the complete disclosures of which are fully incorporated herein by reference.

FIG. 1 further represents in the partial cutaway exposure thereof the fact that foam topper 24 may be provided with particular underside features for accommodating and receiving an air cylinder(s). In particular, the end generally 30 of an exemplary longitudinal air cylinder is represented as positioned near one end of patient support surface 10. Different numbers and sizes of generally longitudinal air cylinders may be practiced, and as will be further understood with reference below to additional figures. Laterally-positioned air cylinders may also be practiced with variations of the subject invention.

Area 32 illustrated in present FIG. 1 represents a closeable patch or flap which may be selectively opened for access to various aspects of the contained features of a given embodiment. For example, connecting air tubing may pass between exemplary air cylinder 30 and a faceplate contained under flap 32, with such faceplate having a valve for accessing the interior environment of air cylinder 30. In some embodiments, closeable flap 32 may serve as a cover for electrical connections as well as pneumatic connections or other features to be accessed for either operational, manufacturing, or maintenance purposes.

It is to be understood from FIG. 1 that the interior contents, such as foam topper 24 and air cylinder 30 (and other air cylinders) may be varied or modified in given embodiments so as to create a modular assembly involving cover 12, perimeter bolster 14, and other components common to several different embodiments. Specific examples of such embodiments are discussed in greater detail below with reference to other figures.

Figure 2:
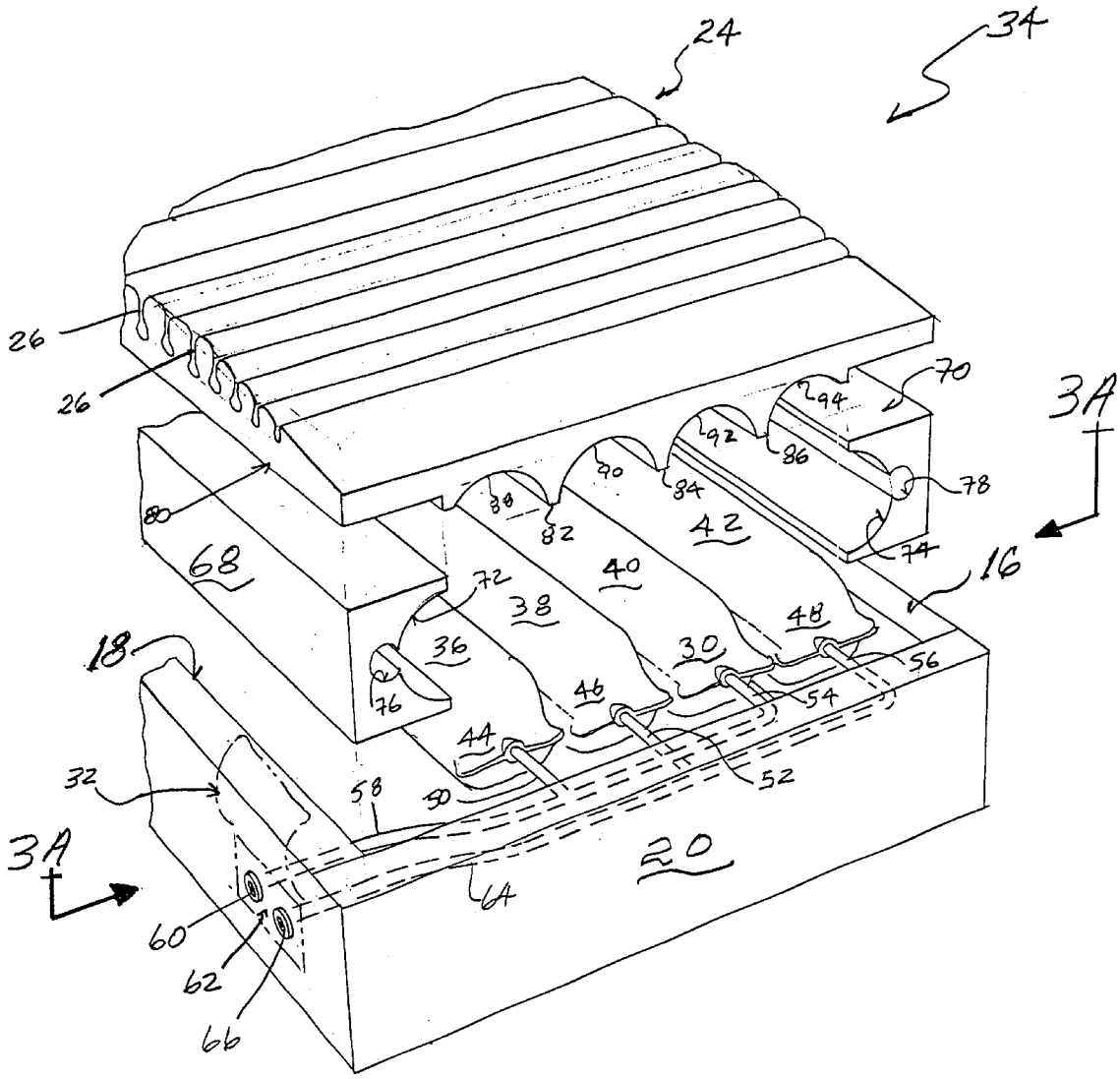
FIG. 2 is an exploded generally top and mostly end perspective view of a portion of a first embodiment of the subject invention (with an outer cover thereof removed), primarily relating to a rechargeable static, non-powered patient support surface.

FIG. 2 is an exploded generally top and mostly end perspective view of a portion of a first exemplary embodiment generally 34 of a patient support surface in accordance with the subject invention. Outer cover 12 is removed for clarity. Features in common with FIG. 1 and other embodiments are marked with like reference characters, without further specific discussion.

In addition to being an exploded view, it is to be understood that FIG. 2 (and figures as similarly illustrated, such as FIGS. 6, 7, 8, and 9) are partially cutoff so as to primarily show one end of an exemplary subject patient support surface. Therefore, it is to be understood that each such embodiment, such as in FIGS. 2, 6, 7, 8, and 9 are at least partially represented by the more complete view of present FIG. 1, which shows the full perimeter and size of an exemplary patient support surface. In other words, it is to be further understood that additional features of the embodiment partially shown in FIG. 2 (as well as those partially shown in FIGS. 6, 7, 8, and 9, respectively) as needed for a complete device are otherwise illustrated in the overall illustration of FIG. 1, or otherwise disclosed herein by the specification or other figures.

FIG. 2 represents the exemplary use of four longitudinal air cylinders 36, 38, 40, and 42. Each such air cylinder has a respective end 44, 46, 30 and 48, at which a connection is made with a respective section of air tubing 50, 52, 54, and 56. Such air tubing interconnects with the interior of the respective air cylinders to facilitate initially establishing the air pressure therein and/or later adjusting such amount of air pressure.

As represented by way of example in the embodiment of present FIG. 2, air tubing 50 and 54 are interconnected with a single tube 58 which emerges at a valved opening 60 in a faceplate 62 situated under closeable flap 32, formed in and through bolster element 18 of perimeter bolster 14. Similarly, air tubing 52 and 56 interconnect with a single line of air tubing 64 which emerges at its own respective valve output 66 also formed in faceplate 62. While the exemplary construction of present FIG. 2 illustrates that the four air cylinders are linked in such two interlaced pairs, it is to be understood that the respective air tubing elements 50, 52, 54, and 56 could likewise be separately terminated in their own respective valving elements found in faceplate 62, or alternatively combined in other ways.

As will be discussed in greater detail below, selective access via flap 32 to valves 60 and 66 enables the air pressure within air cylinders 36, 38, 40, and 42 to be adjusted.

Another aspect of the modular assembly of the subject invention is represented in present FIG. 2 by a pair of inner bolsters 68 and 70, which run longitudinally along the lengthwise axis of patient support surface 34. As illustrated, each inner bolster 68 and 70 has a respectively inwardly facing concave surface 72 and 74 which interacts with part of the curvature of respective air cylinders 36 and 42. Still further, each concave face 72 and 74 is provided with at least one respective curved slot 76 and 78, respectively, therein, for purposes as further discussed below.

FIG. 2 further represents additional aspects of the present modular assembly, particularly as relates to features formed on the underside surface generally 80 of foam topper 24. As shown, a plurality of depending elements 82, 84, and 86 constitute projections which approximate inverted contoured triangles. Otherwise formed in the underside surface 80 of foam topper 24 are a plurality of downwardly facing arches generally 88, 90, 92, and 94. As will be understood by those of ordinary skill in the art, such respective arches run along the longitudinal length of foam topper 24 formed in the underneath side 80 thereof. Likewise, the underside arches interact and interface with the generally top sides of the respective air cylinders 36, 38, 40, and 42, such that the depending elements 82, 84, and 86 work into the areas between the respective air cylinders, as discussed in greater detail below and as otherwise represented in FIGS. 3A and 3B.

The resulting combination cradles and surrounds the air cylinders, providing an interlocked, integrated design having flexible, progressive support while maximizing structural integrity.

Such integrated structural integrity includes the beneficial tube capturing effects of the side or inner bolsters 68 and 70, as well as the beneficial effects of perimeter bolster 14.

Figure 3A:
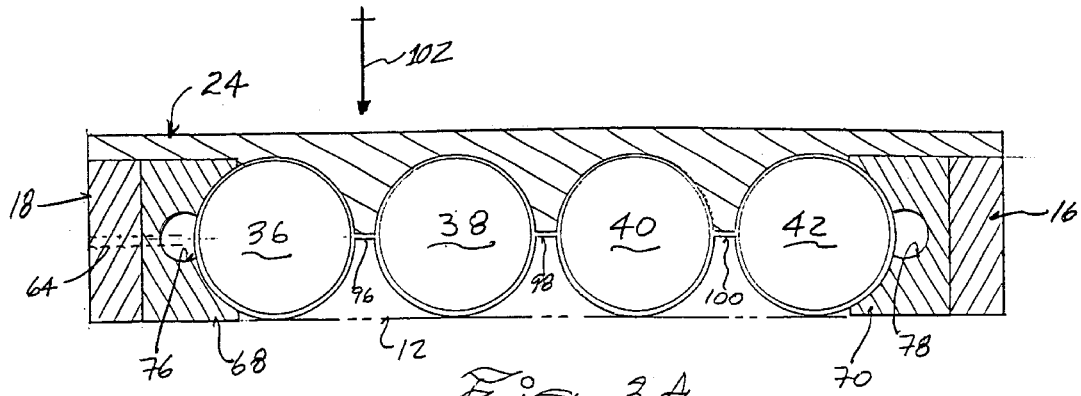
FIG. 3A is a cross sectional representation, taken generally along the position of the section line 3A—3A of present FIG. 2 (otherwise shown in an exploded view) as such embodiment in part would appear in assembled form.

FIG. 3A illustrates a generally cross-sectional view of the FIG. 2 embodiment, when assembled, so as to show the placement relationship among the air cylinders and various modular foam components referenced above. The locations of foam topper 24, perimeter bolster components 16 and 18, and inner or side bolsters 68 and 70 are all distinguished by the use of differentiated cross hatching, as will be well understood by those of ordinary skill in the art. For the sake of clarity, certain reference characters and lead lines are omitted, such as referring to the specific arches 88, 90, 92, and 94 and the depending elements 82, 84, and 86. A general outward path of an exemplary air tube is represented in dotted line by air tube 64. It is to be understood that the discussion above with reference to FIG. 2 is fully applicable to such features as set forth in present FIGS. 3A, or as otherwise presented in other figures.

More particularly represented in the cross-sectional view of present FIG. 3A are wide welds 96, 98, and 100, which are created for holding together adjacently respective pairs of air cylinders. In other words, the weld 96 existing between air cylinders 36 and 38 helps to prevent relative lateral separation of such air cylinders as a force is directed there against, for example, generally in the direction of force arrow 102.

In general, the air cylinders are integrally formed so as to be reinforced, fabricated from, for example, high tinsel woven nylon fabric fused to heavy gauge polymeric film. While welds 96, 98, and 100 strengthen the arrangement of respective air cylinders, they also permit each air cylinder to react independently to patient movement.

Yet another advantageous support feature which may be practiced in accordance with the subject invention is represented by present FIG. 3A. In particular, the overall support strategy achieved with the structural arrangement of present FIG. 3A may be enhanced by utilizing foam having different support characteristics. For example, in relation to each other, perimeter bolster 14 (only components 16 and 18 thereof are represented in FIG. 3A) may be of relatively more dense material for relatively greater support than side or inner bolsters 68 and 70, which in turn may be of relatively greater density or firmer support than foam topper 24. For specific examples, it will be understood by those of ordinary skill in the art that various nomenclatures may describe support characteristics of a given piece of foam. In this instance, ILD is intended to refer to the known characteristic of so-called indentation load deflection. Indentation load deflection (ILD) may be defined as the number of pounds of pressure needed to push a 50 square inch circular plate into a pad a given percentage deflection thereof. For example, a 25 percent ILD of 30 pounds would mean that 30 pounds of pressure is required to push a 50 square inch circular plate into a four inch pad a distance of one inch (i.e., 25 percent of the original, unloaded thickness).

Using a 25 percent ILD characteristic for description purposes, perimeter bolster 14 (including all elements 16, 18, 20, and 22 thereof) may comprise about a 54 pound ILD, while side or inner bolsters 68 and 70 may each comprise about a 50 pound ILD and while foam topper 24 comprises about a 35 pound ILD. Such arrangement results in further beneficial advantages, as discussed in greater detail below with reference to FIG. 3B.

Figure 3B:
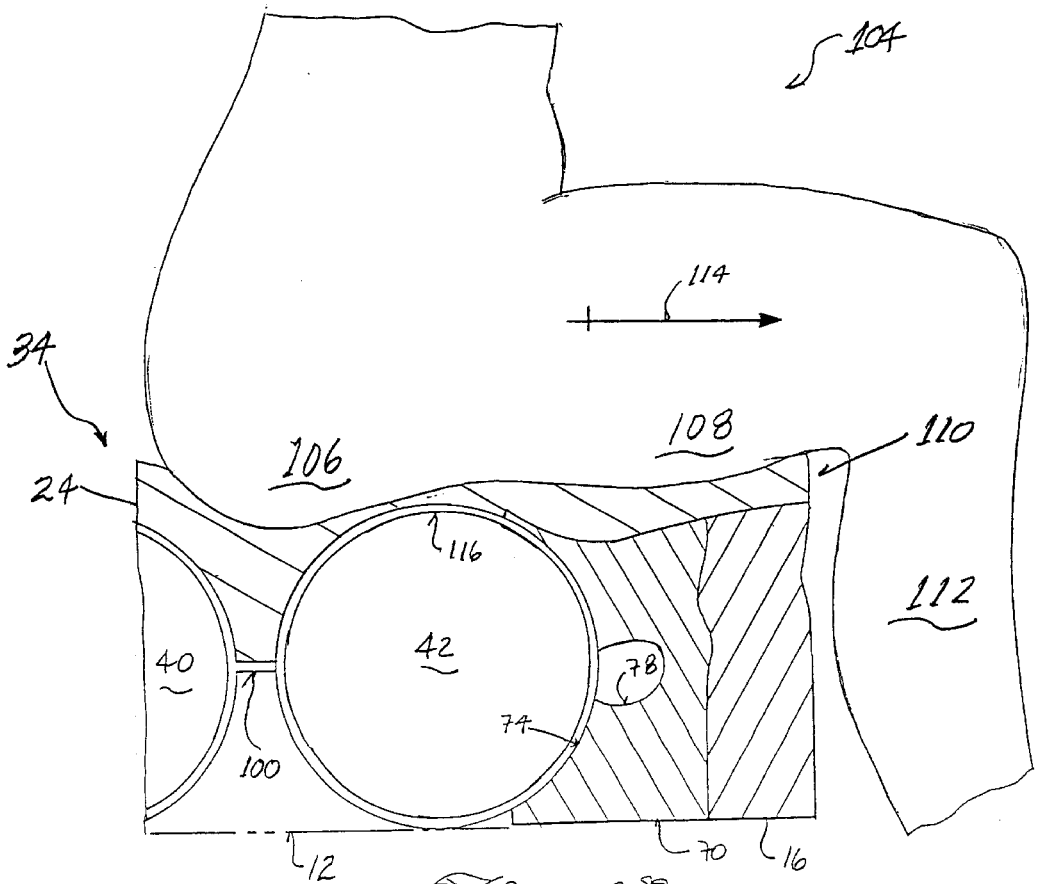
FIG. 3B is an enlarged partial view of the cross section of present FIG. 3A, shown during exemplary reaction of such arrangement during patient use thereof, for improved controlled entry to or egress from the exemplary patient support surface.

FIG. 3B represents an enlarged, partial view of the generally right hand portion of the illustration of present FIG. 3A. In other words, such further cross-sectional view is provided to show interaction with a diagrammatic representation of a patient generally 104 who is seated on the edge of the patient support surface generally 34. As diagrammatically represented, the buttocks generally 106 of patient 104 is situated on the upper surface of patient support surface 34, while the upper leg portions generally 108 are draped over a side or lateral edge generally 110 of patient support surface 34. Such position permits the lower legs generally 112 to hang over the side of the patient support surface with the feet (not shown) touching or above a floor surface.

FIG. 3B represents an exemplary position of a patient 104 when sitting on (i.e., partially over) the edge 110 of the patient support surface 34. Such position may either be desired as a stable temporary position, or may occur during the intermediate stages of entry onto or egress from the patient support surface 34. In either of such cases, FIG. 3B represents a number of features in accordance with the subject invention which help to maintain a stable support environment for the patient, for improved patient safety. In other words, the resulting structure and practice of the present invention results in roll protection, to prevent a patient from being artificially accelerated in the direction of arrow 114 as the patient's center of gravity passes over the top point generally 116 of air cylinder 42. Both the overall construction of the arrangement of present FIG. 3B, as well as the differential foam characteristics which may be utilized, contribute to the patient protective features described herein.

As represented in present FIG. 3B, the relatively denser materials comprising perimeter bolster elements 16 and side or inner bolster 70 deflect relatively less than the deflection which occurs in relatively softer (i.e., less dense) material of foam topper 24. Also, when comparing FIG. 3A with FIG. 3B, it will be understood by those of ordinary skill in the art that the generally circular slot 78 formed in the concave face 74 of side bolster 70 distorts or otherwise deflects so as to permit controlled reaction of air cylinder 42. The result is safer patient entry and egress with maximized structural integrity, all in an embodiment which lends itself to multiple variations for modular assembly of different models within an entire product line of related patient support surfaces.

Another consequence of the patient protection features described herewith relates to the safety of the patient while laying down on the patient support surface. As well understood by those of ordinary skill in the art, patients often voluntarily or involuntarily move on a patient support surface. Such movement can lead to situations where patients approach the edge of a patient support surface. The "edge" features described above in such circumstance operate so as to gently prompt the patient towards the center of the bed, but without requiring awkward buildups or blocking elements which would otherwise obstruct entry or egress. Hence, the resulting arrangement in accordance with the subject invention also facilitates safer resting and safer (i.e., better controlled) transfers between a patient support surface and, for example, a transporting gurney.

Another aspect of the subject invention is that variations of the different components may be practiced. For example, the singular generally circular slot 78 for bolster 70 may potentially be replaced in some embodiments with plural slots and/or slots of different basic shapes.

Likewise, different dimensions may be practiced. For example, side bolster 70 (and opposite side bolster 68) may have a height and depth of about 5 inches for each such dimension. In such instance, the radius of curvature for curved concave face 74 may be in a range of from about 2 inches to about 3 inches, while the radius of curvature for circular slot 78 is about three-quarters of an inch. Variations of all such features may be practiced, so long as the basic illustrated structure functions as described.

Figure 4:
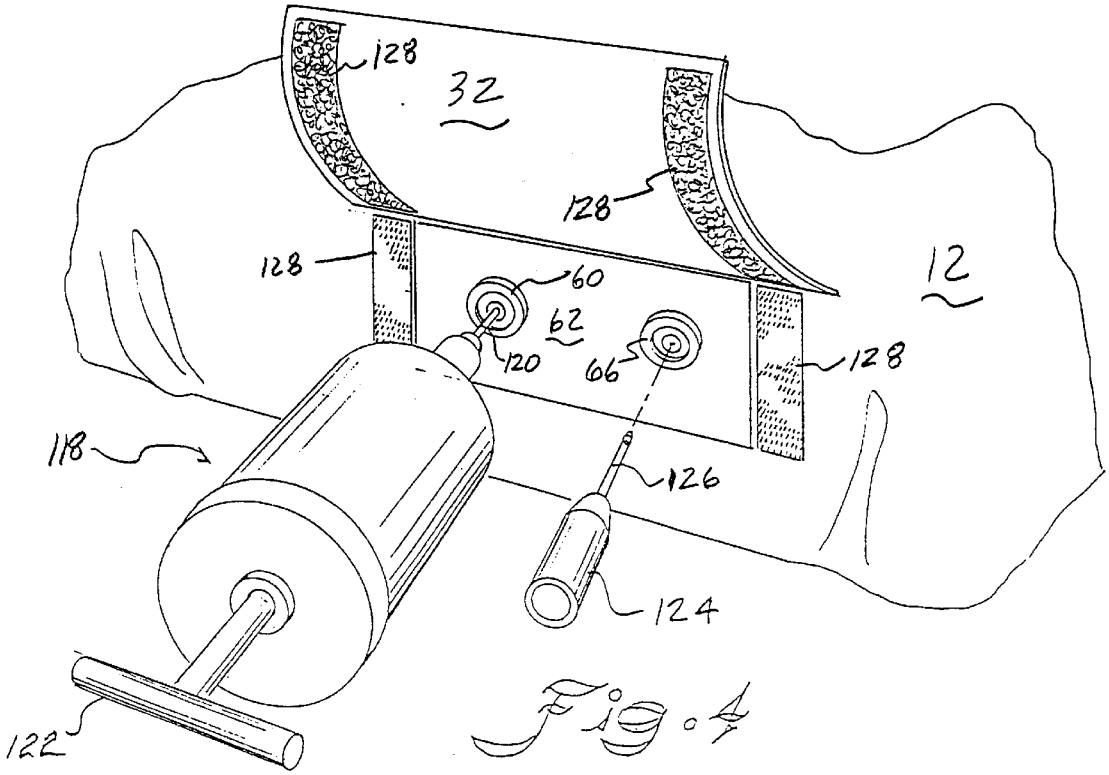
FIG. 4 is an enlarged partial perspective view of an external segment of the embodiment of FIG. 2, represented during practice of the present methodology for recharging such static, non-powered patient support surface embodiment of present FIG. 2.

FIG. 4 shows a greatly enlarged, isolated view of a portion of the exterior cover 12, focused on the closeable flap 32 and faceplate 62 therebeneath, such as described above with general reference to present FIGS. 1 and 2. In the example shown, a pair of valve elements 60 and 66 provide pneumatic access to the interior of air cylinders 36, 38, 40, and 42. As understood by those of ordinary skill in the art, such valves may preferably comprise check valves which normally remain closed until penetrated by a needle, inserted for the purposes of bleeding off air or adding air to the enclosed environment.

In this instance, it is to be understood that air cylinders 36, 38, 40, and 42 are operative in a static, non-powered arrangement, such that there is no escape or entry of air intended relative to such air cylinders during normal operation thereof. In other words, as situated, they operate to redistribute and equalize air pressure along the length of the respective air cylinders, without escape or entry of any air during such operation. On the other hand, air is introduced into such air cylinders whenever they are originally outfitted at a manufacturer's location, to suit original manufacturing specifications. In other words, they are initially inflated to a predetermined level.

In this instance, the respective air cylinders may be "recharged" so as to be returned to their original manufacturer's specification. In this way, any interim leakage, for example, which may occur over several months time during use, or due to atmospheric differences, may be corrected in the field, such as at a hospital, nursing home, or in a home healthcare environment.

As represented by present FIG. 4, any air source may be utilized, but one preferred approach is for use simply of a hand air pump generally 118 provided with an insertion needle 120 for penetrating either valve 60 or 66 in relation to their respectively associated air cylinders. As will be readily understood by those of ordinary skill in the art, handle 122 may be utilized for forcing air out through openings associated with the forward or distal end of needle 120 after such needle is inserted as shown in FIG. 4. In this manner, by using either valve 60 or 66, additional air may be introduced into any of the respective air cylinders.

As part of the practice of the present methodology in accordance with this invention, the pump operator need not be aware of the precise amount of air being introduced, such that over inflation will actually occur. Further in accordance with this invention, a precalibrated relief valve generally 124 associated with its own penetration needle 126 may be utilized for bleeding off any excess air down to the predetermined manufacturer's specification for the air pressure within the respective cylinders.

In other words, all the operator (such as a nurse or technician or home user) need do relative to a given valve 60 or 66 is pump air in with pump 118 and then subsequently bleed excess air off with precalibrated valve 124. In this manner, the air pressure within the respective air cylinders of the static, non-powered embodiment is "recharged" or returned to the original manufacturer's specification, all without requiring sophisticated equipment or technique. Moreover, the procedure takes only several simple steps, which facilitates routine scheduled practice of the method. The result is a highly affordable air and foam mattress system for providing a patient support surface. Such procedures may also be practiced during initial set-up, to insure no air losses after shipment, or as part of the initial air pressurization of the air cylinders—in place of such operation by the manufacturer.

Velcro components (well known hook and fabric features) generally 128, or snaps, or the like may be utilized for selectively closing and opening flap 32 relative to faceplate 62. All such features will be well understood by those of ordinary skill in the art without requiring additional disclosure.

Figure 5:
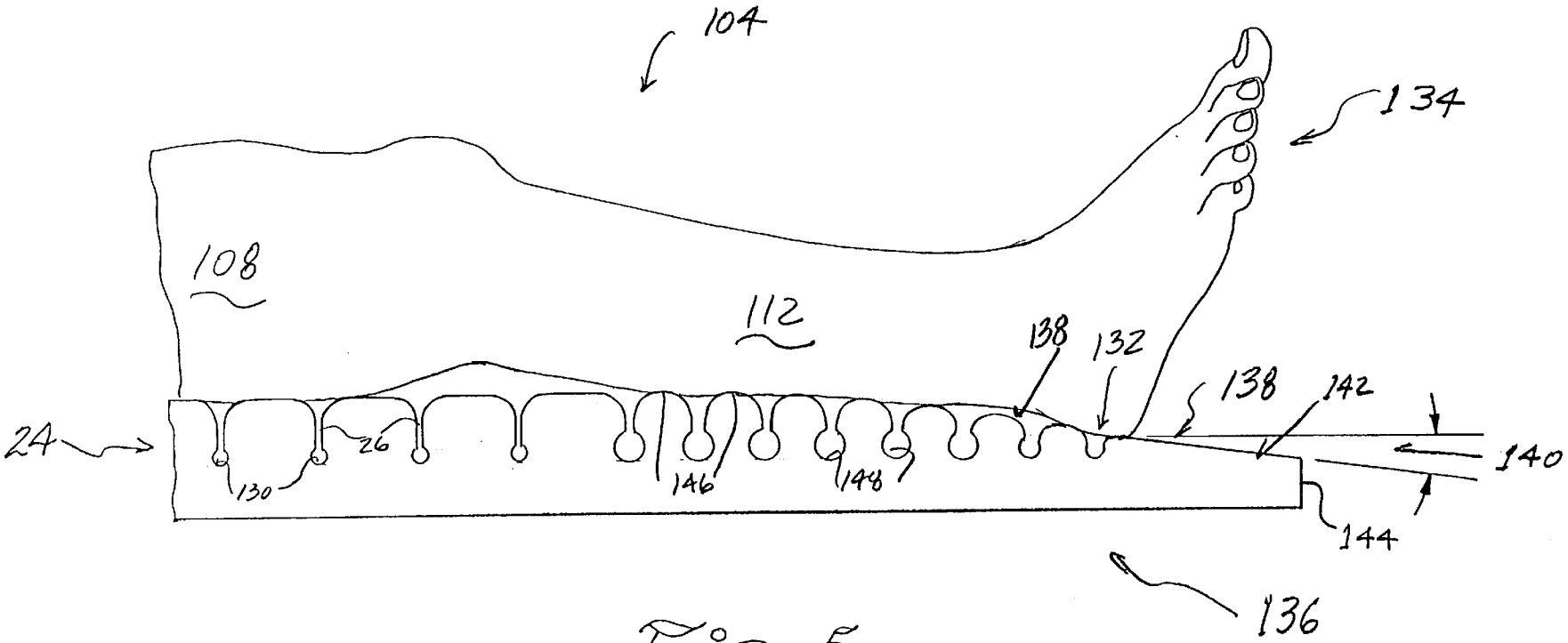
FIG. 5 is an isolated, enlarged side elevational view of sloping heel pressure relief section features which may be integrally incorporated into foam topper components in accordance with the subject invention.

FIG. 5 represents an isolated, enlarged view of an exemplary sloping heel pressure relief section of a foam topper 24 in accordance with the present invention. Such heel pressure relief features may be practiced in a foam topper integrally incorporated with patient support surfaces as illustrated in accordance with this invention, or as part of a separate foam topper added to the top of existing mattresses.

Specifically, FIG. 5 illustrates a side elevational view of a portion of mattress topper 24 intended to support the heel and upper leg portion of an exemplary patient generally 104. The upper leg area generally 108 is supported on a "regular" portion of mattress topper 24, as otherwise represented in the figures. Lateral cross cuts or channels 26 may be provided, as well as air circulation channels 130 at the base of such cuts 26. Longitudinal cuts or channels 28 may be practiced (FIG. 1) but are not seen in this view.

In the area of lower leg 112 and the area of heel 132 of foot generally 134, a number of particular features are provided in section generally 136 of mattress topper 24. For example, an overall angular slope is introduced to a portion of the upper support surface generally 138 of mattress topper 24, as represented by angle generally 140. While such exact angle may vary in a range, such as from about 4 degrees to about 10 degrees (other angles may be practiced), approximately a 6 degree angle is preferred in some embodiments.

A portion of such angled surface area includes a generally flat upper support surface 142, which extends down to a base portion or height generally 144, below which the thickness of the base 144 does not further reduce. In other words, there is a minimum base thickness which is maintained, despite an angled upper surface 138 for the sloping heel pressure relief section generally 136.

As represented best by present FIG. 5, the sloping portion is primarily achieved by a reduction in the size and shape of the respective supporting elements or line of elements, for example, elements 146. The progressive reduction thereof may also be accompanied with a relatively increased size in the circular channels 148 so as to facilitate even greater independence of the respective elements 146 and a greater level of air circulation for the removal of moisture, such as perspiration. All such features collectively achieve a redistribution or transference of load generally from heel section 132 more onto the greater pressure-tolerant lower legs and calves generally 112. As a result, heel pressures are reduced while providing greater foot support and comfort.

For clarity in the remaining figures, such sloping heel pressure relief section features are not separately indicated by reference characters, though clearly illustrated so that those of ordinary skill in the art may understand the orientation of the exemplary pressure support surfaces and the exemplary location of such features relative to the illustrated embodiments. Also, the omission of any underside features in the exemplary illustration of present FIG. 5 is intended to represent potential use of such sloping heel pressure relief section features in embodiments of mattress toppers utilized directly onto the surfaces of existing beds, and not just as integrated into patient support surfaces, as otherwise illustrated herein.

FIGS. 6, 7, 8, and 9 represent similar perspectives of partial illustrations of exemplary second, third, fourth, and fifth embodiments, respectively, of patient support surfaces in accordance with the subject invention. Each such figure represents a generally top and mostly end perspective view, exploded, of a portion of a particular form of patient support surface (with the outer cover removed). As such, each represents certain features as being in common, which results in advantageous modular assembly features achieved with the present invention. For clarity and reduced individual description, like components have the same reference characters as those of FIG. 2, and description related to all such elements in FIG. 2 is applicable to the respective FIGS. 6, 7, 8, and 9 to the extent that such elements are set forth therein, without requiring additional separate discussion.

Figure 6:
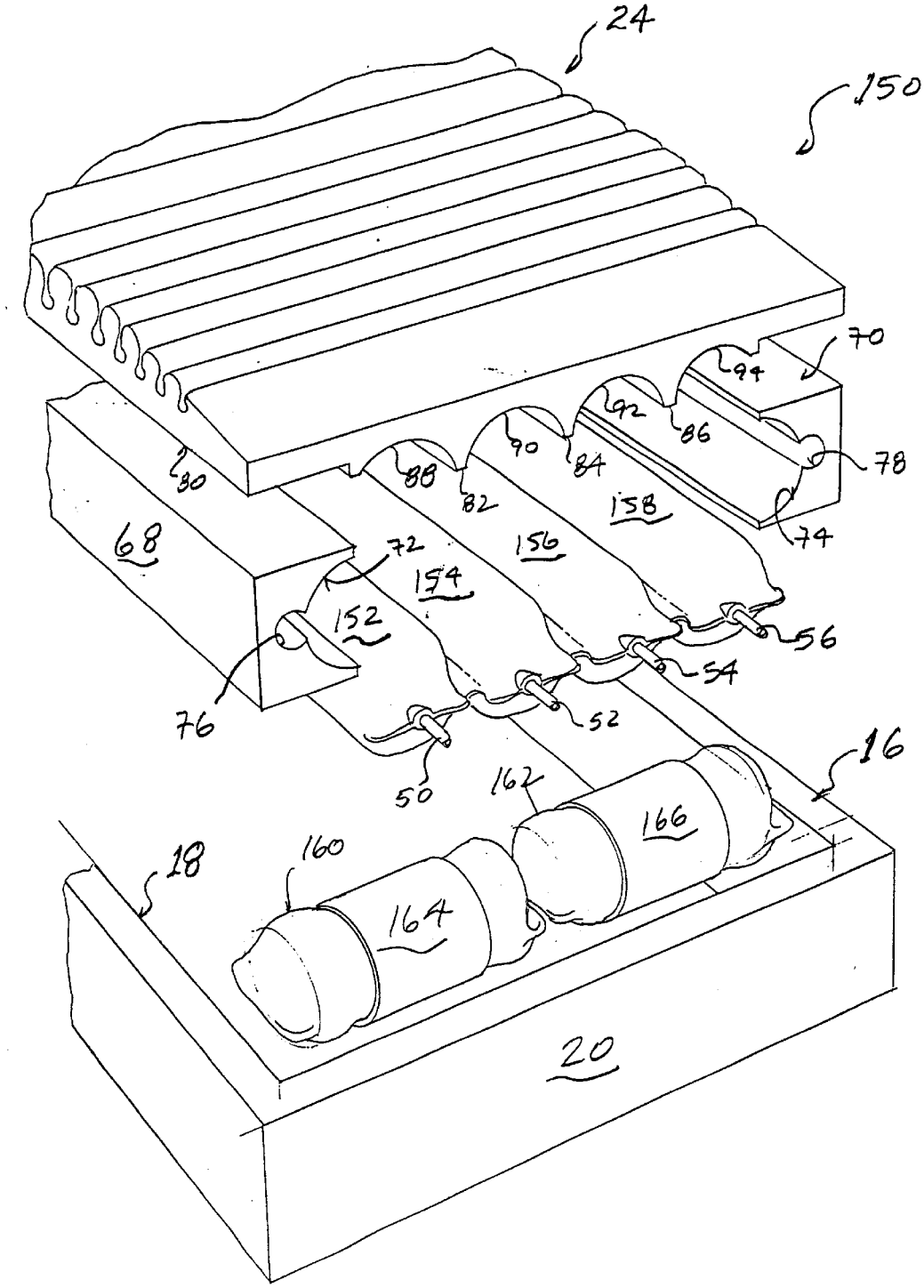
FIG. 6 is an exploded generally top and mostly end perspective view similar to that of present FIG. 2 (and also with an outer cover thereof removed), but representative of a portion of a dynamic, non-powered patient support surface embodiment, comprising a second embodiment of a patient support surface in accordance with the subject invention.

More specifically, FIG. 6 illustrates an embodiment of a dynamic, non-powered patient support surface generally 150 utilizing foam topper 24, perimeter bolster 14 (represented by elements 16, 18, and 20 thereof), and side or inner bolsters 68 and 70. An exemplary number (four) of longitudinal air cylinders generally 152, 154, 156, and 158 are provided. In essence, they may be the same as air cylinders 36, 38, 40, and 42, except not as long, so as to also accommodate within perimeter bolster 14 other elements as discussed herein.

More specifically, added reservoirs 160 and 162 may include elasticized wraps 164 and 166 respectively for comprising resiliently actuated reservoirs associated with respective of the air cylinders 152, 154, 156, and 158. Air tubing 50, 52, 54, and 56 may be individually or in pairs connected with one or more of the elasticized reservoirs 160 and 162 (air connections not shown for clarity). With such arrangement, the air level in the air cylinders dynamically reacts to changes in pressure loading, by pressing or pumping excess air into reservoirs 160 or 162 (by the excess loading), and alternately forcing air back into the air cylinders from such reservoirs when needed (by the resiliency of the wraps), until a dynamic balance is achieved. Such system is referred to as being "non-powered" since the resiliency of the elasticized wraps 164 and 166 provides for the dynamic action, without requiring electric power. Complete details of such arrangements are set forth in commonly owned U.S. Pat. Nos. 5,649,331 and 5,652,985, the complete disclosures of which are fully incorporated herein by reference.

It is to be understood that such dynamic, non-powered embodiment of present FIG. 6 may be provided with other numbers of air cylinders and/or air reservoirs, all interconnected in various fashions so as to achieve desired operation, all without change to the basic layout, cooperation, or function of the perimeter bolster, foam topper (with underside features) and side bolsters. It is likewise to be understood that all such features could be positioned exactly as shown, without regard to the manner in which tubing interconnections are varied. For such reason, and in view of the incorporation by reference of the above-noted '331 and '985 commonly owned patents, the exact air tubing connections which could be made do not need to be separately illustrated in present FIG. 6 for an adequate understanding of the subject invention, and so are only diagrammatically represented therein.

Figure 7:
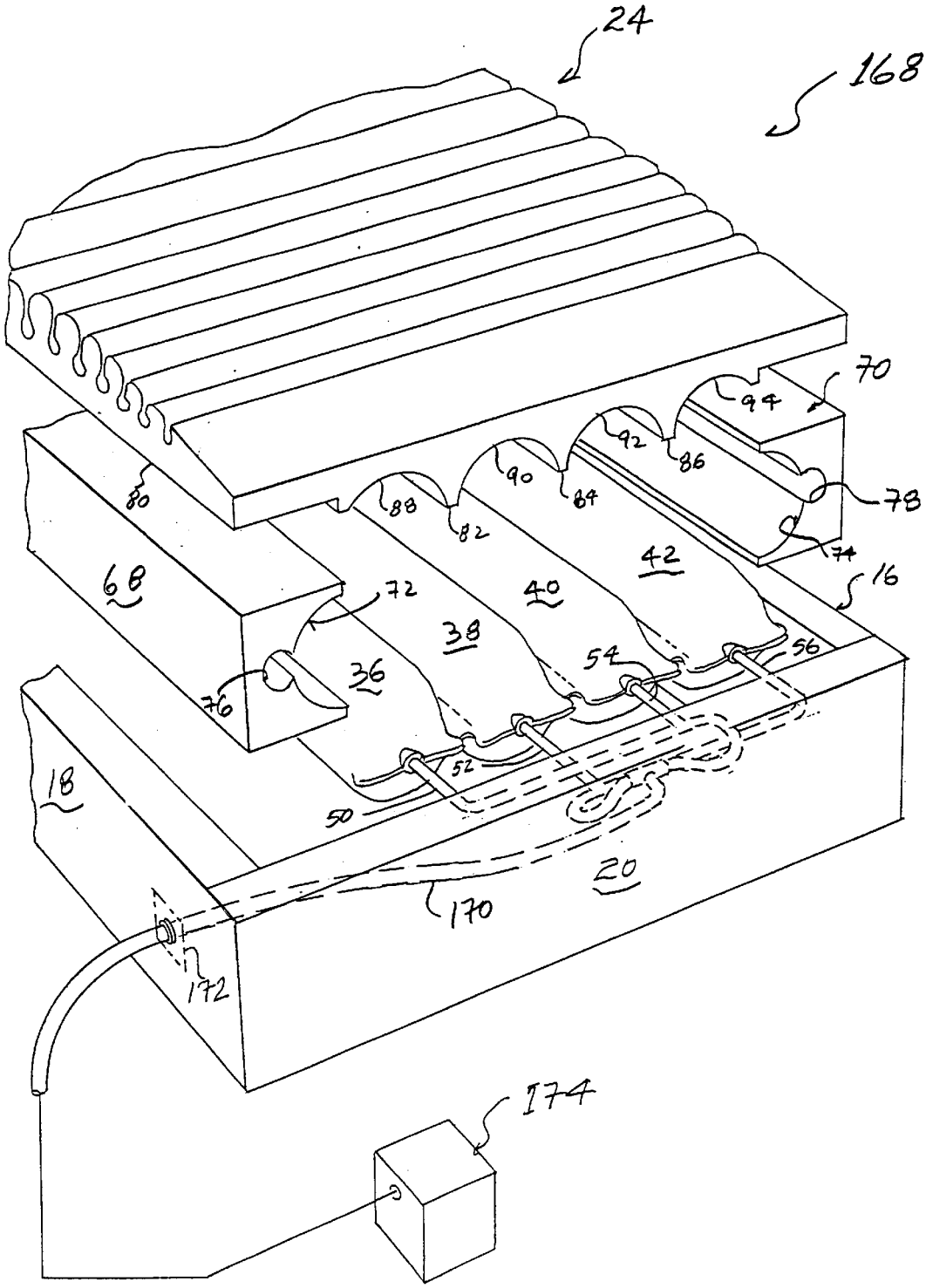
FIG. 7 is an exploded generally top and mostly end perspective view of a portion of a third embodiment of a patient support surface in accordance with the subject invention (also with an outer cover thereof removed), primarily related to a dynamic, powered embodiment thereof, where the power and control elements are primarily external to the overall construction.

FIG. 7 represents a dynamic, powered embodiment of a patient support surface generally 168 in accordance with the subject invention, wherein the "power" components are generally external to the construction. In other words, the components or features necessary to pump additional air into or out of respective air cylinders 36, 38, 40, and 42 primarily are external to arrangement generally 168.

More specifically, by way of diagrammatic representation, and intended as representational only, a single line 170 is represented as emerging from arrangement 168 via perimeter bolster element 18 through a faceplate 172. Interconnection is made to a representative means 174 for powering changes to the air within the respective air cylinders 36, 38, 40, and 42. Individual air tubes, paired air tubes, or a collective air tube arrangement may all be practiced, and is intended to be represented by the single interconnecting air tube represented by 170.

The represented means 174 represents the potential use of various feedback sensors, pumps, electronic controls, and valve and manifold systems as may be needed and/or utilized as desired in a dynamic bed system. It should be understood that reference to electronic controls means both electronics and in some instances programmable components and their operating software. It should also be recognized that the illustrated arrangement of plural, respective, longitudinal air cylinders may be controlled and operated so as to produce an alternating pressure feature, for periodically therapeutically stimulating a patient. Various constructions of such features are well known to those of ordinary skill in the art, and form no particular aspect of the subject invention, outside of the context as represented by present FIG. 7.

Figure 8:
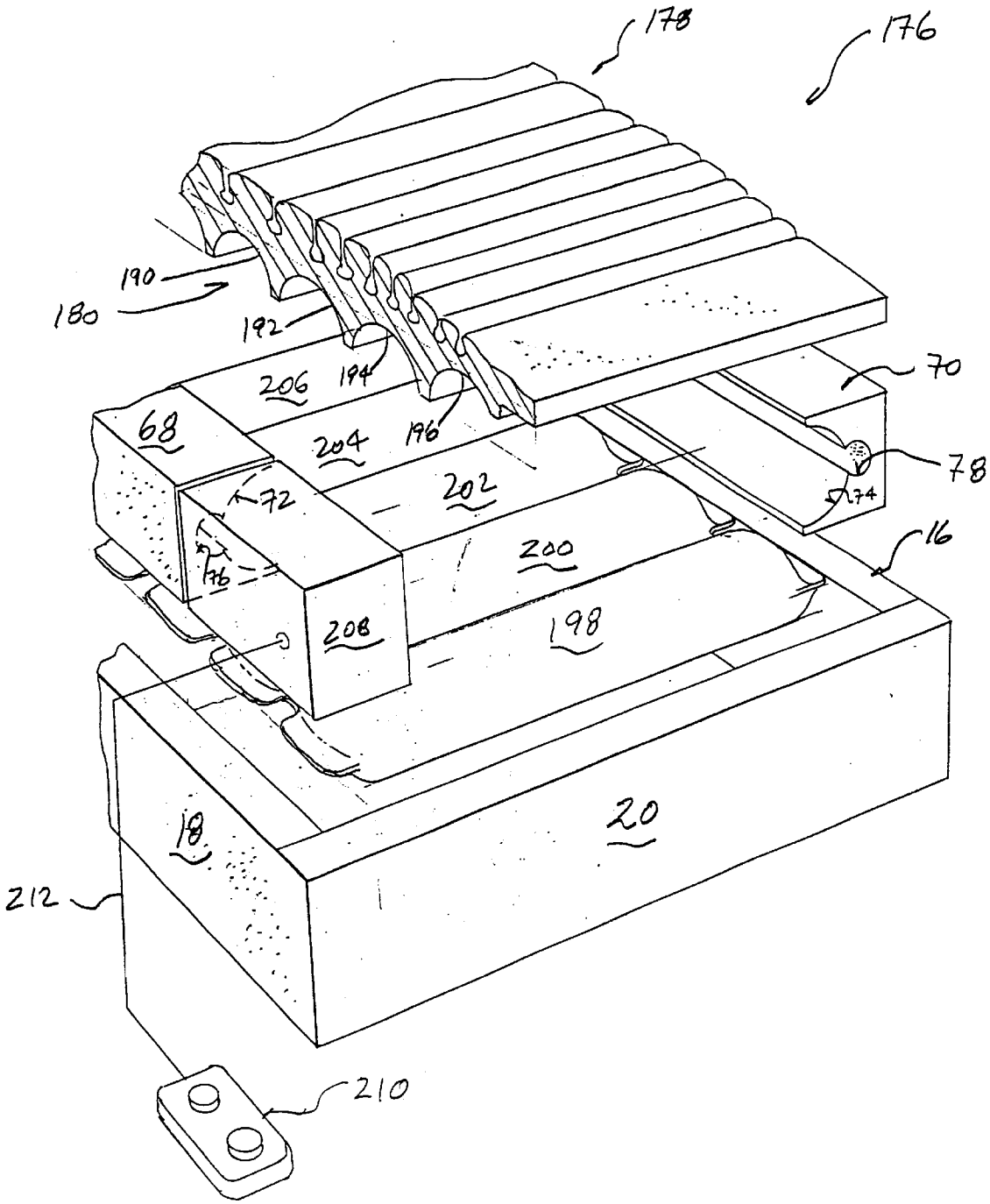
FIG. 8 is an exploded, generally top and mostly end perspective view of a portion of a fourth embodiment of a patient support surface in accordance with the subject invention (also with an outer cover thereof removed), primarily related to a dynamic, powered embodiment wherein the power and control features are primarily integrated into the overall construction, which also incorporates lateral air cylinder placements.

FIG. 8 represents a dynamic, powered patient support surface generally 176 in accordance with the subject invention, wherein the power components thereof are primarily internally arranged (i.e., self-contained), and further wherein the air cylinders are laterally positioned. Again, the embodiment of present FIG. 8 includes certain features in common with previous embodiments, and are accordingly marked with common reference characters, without further discussion.

The upper surface of a foam topper generally 178 may be provided as in other embodiments (including the sloping heel pressure relief section thereof), but has an undersurface generally 180 which is otherwise adjusted so that the underneath arches 190, 192, 194, 196, and the like are turned so as to be lateral relative to the longitudinal length of the patient support surface generally 176. Such position corresponds with the lateral position of air cylinders generally 198, 200, 202, and 204.

Such four air cylinders 198 through 204 may comprise a group set of air cylinders which are commonly controlled for reducing pressures in the generally lower section of a patient. An additional grouping of lateral air cylinders (including air cylinder 206 and other air cylinders not shown), for example, may be provided for reducing pressures under dynamic control in relation to the midsection of a patient. Further air cylinders (not shown) may be utilized in a group for dynamic support of the upper portion of a patient, so that collectively a number of sites are provided along the length of a patient for separately dynamically controlled pressure relief.

Other arrangements may be practiced, such as four groups or zones of three air cylinders each, covering respectively the head, upper torso, lower torso, and heel sites of a patient.

A further aspect of the embodiment of present FIG. 8 is that control means or mechanisms generally 208 may be provided contained within the arrangement of patient support surface 176. To accommodate such arrangement, a portion of the foam inner bolster 68 may be cut away to provide a space in one lateral side adjacent the foot end of patient support surface 176.

Such control mechanism 208 may contain features as similarly described above with reference to control mechanism 174 of present FIG. 7. Likewise, interconnecting air tubes or sensor feedback paths are not separately shown, for the sake of clarity, and due to the fact that such features may vary among different embodiments depending on the selection of air cylinders to be grouped or not grouped for dynamic operation. Also, it will be understood that internal slots 76 and 78 of inner bolsters 68 and 70, respectively, may be used for a double purpose of providing a passageway for various of such air tube placements, or wires or the like for feedback pathways.

An additional feature of present FIG. 8 illustrated is use of an outside or exterior control pendant generally 210, greatly simplified for purposes of illustration. Such control pendant may be electronically connected via wiring 212, which passes through covering 12 (not shown) of patient support surface 176 so as to interconnect with the control mechanism 208 thereof. By such pendant 210, surface 176 may be programmed for different modes of operation, such as a body site specific focus or for an alternating pressure feature as with FIG. 7, albeit involving lateral cylinders rather than longitudinal. Of course, any of such dynamic embodiments may be operated for more straightforward equalization of pressure among respective patient sites.

Figure 9:
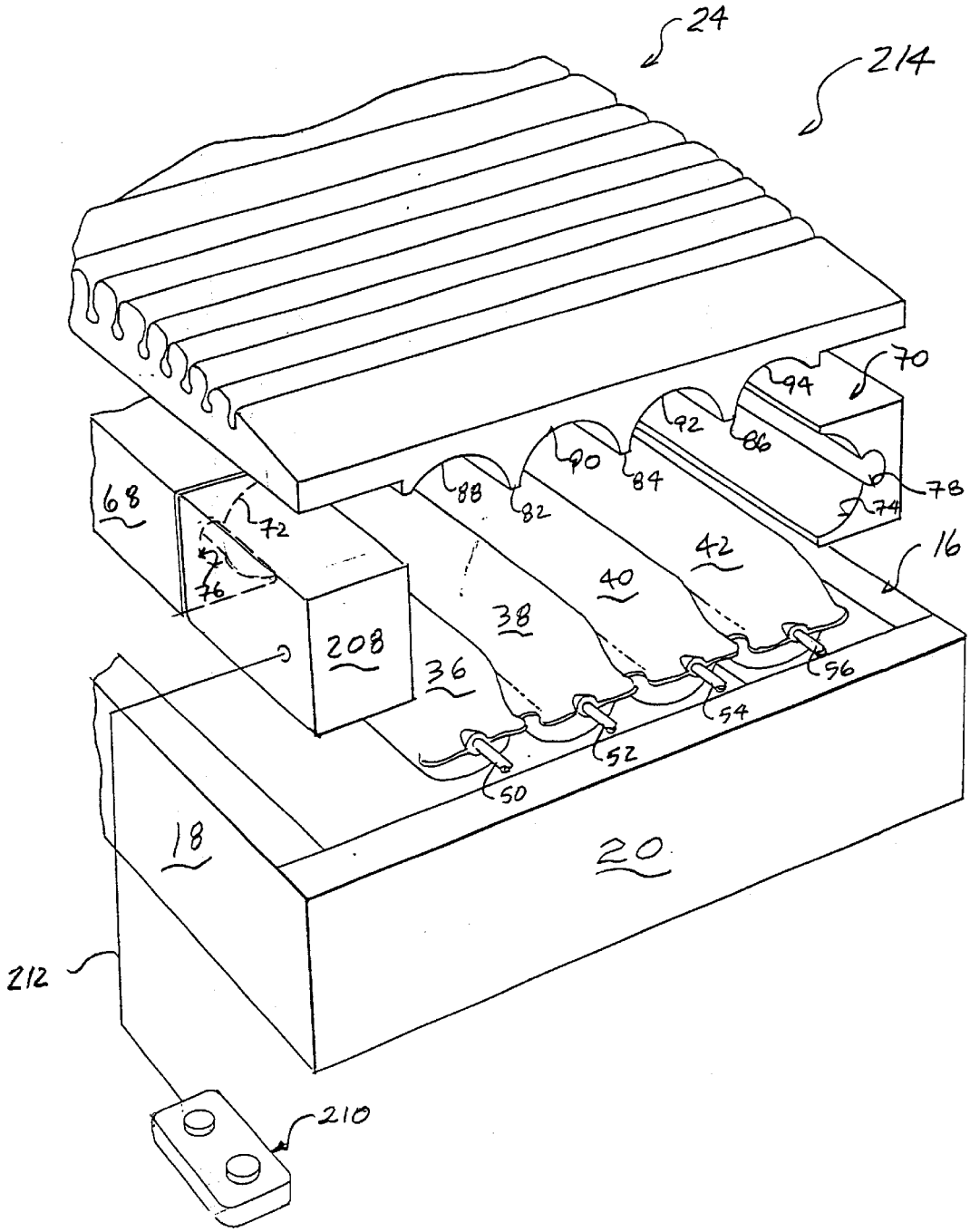
FIG. 9 is an exploded, generally top and mostly end perspective view of a portion of a fifth embodiment of a patient support surface in accordance with the subject invention (also with an outer cover thereof removed), primarily related to a dynamic, powered embodiment wherein the power and control features are primarily integrated into the overall construction, which also incorporates longitudinal air cylinder placements.

FIG. 9 represents a fifth embodiment of a patient support surface generally 214 in accordance with the subject invention, involving another version of a dynamic, powered surface. The arrangement 214 is similar to FIG. 7 in that it makes use of longitudinally positioned air cylinders 36, 38, 40, and 42. At the same time, it is similar to the embodiment of present FIG. 8 because it makes use of internally located (i.e., self-contained) control mechanisms 208, with an external control pendant 210 interconnected via electrical lines 212. Other features thereof will be understood from the use of common reference characters and the above discussion of such features in relation to other embodiments.

Also, the FIG. 9 embodiment is likewise capable of operating in various "programmed" modes. In addition to some of the modes discussed above, it is capable of so-called lateral rotation operation, whereby a patient is literally rotated about their longitudinal axis, up to 30 degrees, for therapeutic stimulation.

In addition to the many variations referenced above, it is to be further understood that other variations may be practiced so as to combine different features for obtaining patient support surfaces of types not illustrated, while also making use of the various foam components permitting modular assembly as discussed above. Likewise, it is to be understood that various of the respective illustrated embodiments may be modified as desired. For example, specific numbers or sizes of air cylinders may be used, in either longitudinal and/or lateral arrangements, or mixed arrangements thereof. Likewise, variations may be practiced with characteristics of different foam components, such as varying the ILD characteristics thereof or the constructions of certain support surfaces, such as the upper support surface of foam topper 24. Different embodiments may also be directed to different sized beds (such as twin, full, queen, or king) or to beds having different weight capacities for special need patients. All such variations and modifications are intended to come within the spirit and scope of the subject invention.

What is claimed is:

1. A patient support surface, comprising:

a body of resilient foam material having a base of predetermined minimum thickness and an upper region above said base having respective support elements formed therein for defining a patient receiving surface; wherein said patient receiving surface includes a lower leg and foot supporting area characterized by decreasing angled support relative to the remainder of said patient receiving surface; and wherein said body of resilient foam material has a 25% ILD characteristic of between about 30 and about 60 pounds.

2. A patient support surface as in claim 1, wherein said upper region in said lower leg and foot supporting area includes respective support elements which are relatively reduced in size and shape for forming said decreasing angled support.

3. A patient support surface as in claim 2, wherein said upper region includes air circulation channels defined between said respective support elements and wherein said air circulation channels are relatively increased in size within said lower leg and foot supporting area, for greater independence of said respective support elements and for greater air circulation, in said lower leg and foot supporting area.

4. A patient support surface as in claim 1, wherein said decreasing angled support is at an angle in a range of from about 4 degrees to about 10 degrees relative to the remainder of said patient receiving surface.

5. A patient support surface as in claim 1, wherein said body of resilient foam is formed as a foam topper for being received on the top of another mattress or further support surface, for use therewith and also comprises a perimeter base of support for said foam topper formed by a set of end rails and side bolsters with inner bolsters therein.

6. A patient support surface as in claim 1, wherein said body of resilient foam is formed in combination with additional support elements for collectively defining therewith a mattress supplement.

7. A patient support surface as in claim 1, wherein said body of resilient foam is formed in combination with additional support elements for collectively defining therewith a mattress.

* * * * *

UNITED STATES PATENT AND TRADEMARK OFFICE

CERTIFICATE OF CORRECTION

PATENT NO. : 6,848,138 B1
DATED : February 1, 2005
INVENTOR(S) : Maier et al.

It is certified that error appears in the above-identified patent and that said Letters Patent is hereby corrected as shown below:

Title page,
Insert Item -- [73] Assignee: Span-America Medical Systems, Inc., Greenville, SC (US) --

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,138 B1
DATED : February 1, 2005
INVENTOR(S) : Edmund K. Maier et al.

It is certified that error appears in the above-identified patent and that said Letters Patent is hereby corrected as shown below:

Column 14,
Lines 11-13, please amend as follows:
-- said body of resilient foam has a "35%" ILD characteristic of between about 30 and about 60 pounds. --
Line 3, please amend as follows:
-- between said respective support elements "," and wherein said --

Signed and Sealed this

Twenty-first Day of June, 2005

JON W. DUDAS
*Director of the United States Patent and Trademark Office*